United States Patent [19]

Hürlemann

[11] Patent Number: 4,884,490

[45] Date of Patent: Dec. 5, 1989

[54] APPARATUS FOR COOLING THE BARREL INNER WALL OF A WEAPON BARREL OF A FIRING WEAPON

[75] Inventor: Ernst Hürlemann, Zürich, Switzerland

[73] Assignee: Werkzeugmaschinenfabrik Oerlikon-Bührle AG, Zürich, Switzerland

[21] Appl. No.: 261,410

[22] Filed: Oct. 24, 1988

[30] Foreign Application Priority Data

Oct. 28, 1987 [CH] Switzerland ..... 04222/87

[51] Int. Cl.[4] ..... F41D 11/20

[52] U.S. Cl. ..... 89/14.1

[58] Field of Search ..... 89/1.2, 1.25, 14.1

[56] References Cited

U.S. PATENT DOCUMENTS

| | | | |
|---|---|---|---|
| 682,230 | 9/1901 | Perino | 89/14.1 |
| 1,401,667 | 12/1921 | Brown | 89/14.1 |
| 2,641,162 | 6/1953 | Balleisen | 89/14.1 |
| 2,774,281 | 12/1956 | Hawkins | 89/1.2 |
| 2,806,409 | 9/1957 | Purcella | 89/14.1 |

FOREIGN PATENT DOCUMENTS

| | | | |
|---|---|---|---|
| 208692 | 5/1908 | Fed. Rep. of Germany . | |
| 6606396 | 12/1966 | Fed. Rep. of Germany . | |
| 3145764 | 6/1983 | Fed. Rep. of Germany . | |
| 1112677 | 7/1952 | France . | |
| 270469 | 1/1930 | Italy | 89/1.2 |
| 221036 | 8/1942 | Switzerland . | |
| 7818 | of 1904 | United Kingdom | 89/14.1 |

*Primary Examiner*—Stephen C. Bentley

*Attorney, Agent, or Firm*—Werner W. Kleeman

[57] ABSTRACT

In order to cool the barrel inner wall of a weapon barrel of a firing weapon at a predetermined location, typically at the rear end region of the weapon barrel, one or more cooling fluid channels are arranged at the barrel wall of the weapon barrel. The cooling fluid channels open at the barrel inner wall. By means of an apparatus which can be actuated by the gas pressure of the propellant gases, there is injected into the interior of the weapon barrel a dosed quantity of cooling fluid after the firing of each cartridge or ammunition round. This apparatus preferably comprises a piston arrangement having a first piston of larger diameter and which is subjected to the gas pressure of the propellant gases and a second piston of smaller diameter at which impinges the cooling fluid.

4 Claims, 1 Drawing Sheet

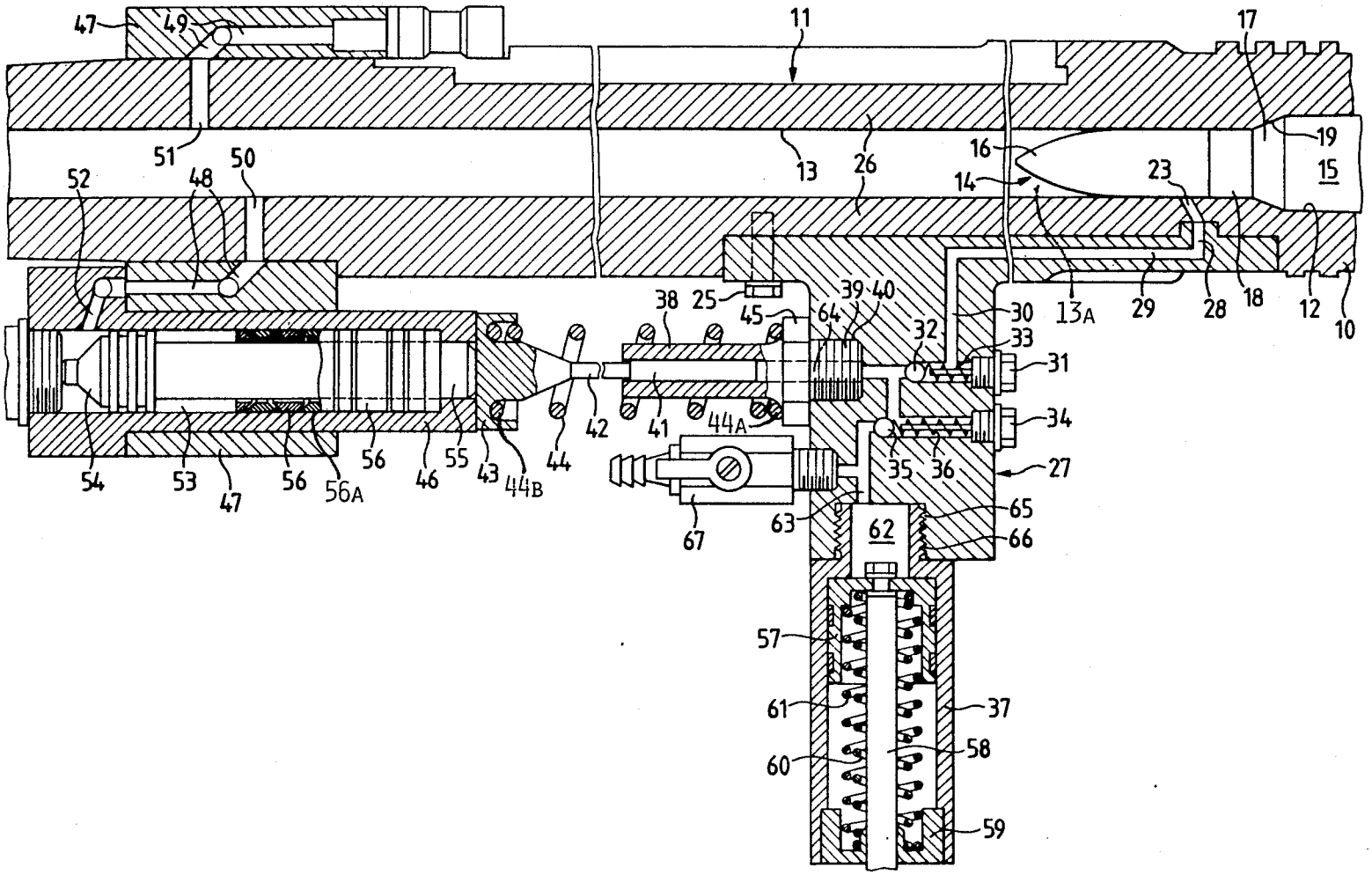
10
12
15
19
17
18
28
23
29
13A
16
14
11
26
13
30
33
31
34
27
65
66
32
36
35
39
40
64
62
63
37
58
59
57
61
60
45
44A
25
38
41
67
42
44
44B
43
55
46
56
56A
56
47
50
48
53
49
51
52
54
47

APPARATUS FOR COOLING THE BARREL INNER WALL OF A WEAPON BARREL OF A FIRING WEAPON

BACKGROUND OF THE INVENTION

The present invention relates to a new and improved construction of an apparatus for cooling the barrel inner wall of a weapon barrel of a firing weapon.

Generally speaking, the cooling apparatus of the present development is of the type comprising at least one cooling fluid channel for the injection of a cooling fluid or coolant, such as typically water, into the interior of the weapon barrel end or end region. There are also provided means for dosing the infeed of the cooling fluid or coolant. The cooling fluid channel is located in the weapon barrel wall and flow communicates with or opens at or into the inner wall of the weapon barrel.

In a prior art gun barrel cooling apparatus of the aforementioned general type, as disclosed in U.S. Pat. No. 2,641,162, patented June 9, 1953, there is provided a slide member which can be actuated by the pressure of the propellant gas. This slide member serves to open and close a coolant fluid channel. After firing of a cartridge or round the pressure of the propellant gas which acts upon a piston and piston rod serves to open the slide member, so that cooling fluid can flow through the cooling fluid channel into the interior of the weapon barrel. The injection pressure required for the injection of the cooling fluid is produced by a non-illustrated cooling fluid pump.

This heretofore known construction of gun barrel cooling apparatus is considered to be afflicted with the drawback that there is required an additional cooling fluid pump and, furthermore, that it is practically not possible with such pump to generate the pressure required for the injection of the cooling fluid.

In the German Published Patent Application No. 3,145,764, published June 1, 1983, there is disclosed a different construction of cooling apparatus for the weapon barrel of an automatic firing weapon in high-performance cannons. This cooling apparatus possesses cooling channels in the drum of the firing weapon which branch-off radially from a cooling channel in the drum axle or axis. The cooling channels are connected with nozzles which freely open into the rearward end of the weapon barrel. The control of the injection operation is accomplished as a function of the rotation of the drum, by means of shutoff elements inserted into the cooling channels. These shutoff elements are constituted by, for instance, slide members or valves provided with valve plungers and valve plates. The injection of the cooling fluid is undertaken only during movement of the nozzles past the weapon barrel, and the cooling fluid is directly injected onto the inner wall surface or gun bore of the weapon barrel.

This prior art construction of cooling apparatus is considered to be associated with the drawback that it only can be employed with a firing weapon equipped with a drum or drum member and cooling fluid can only be injected during a very brief time interval.

In Swiss Pat. No. 221,036, granted May 15, 1942, there is disclosed to the art an air cooling apparatus in which cooling channels are provided at movable breachblock parts or components. On the one hand, these cooling channels open into a chamber arranged rearwardly of the breachblock and, on the other hand, towards the cartridge magazine in the weapon barrel.

These cooling channels possess the smallest cross-sectional area at the mouth directed towards the cartridge magazine.

This last-discussed prior art construction of cooling apparatus for the weapon barrel of a firing weapon is associated with the shortcoming that it is more suitable for air cooling than for liquid cooling and the air only can withdraw a relatively modest quantity of heat or thermal energy.

In French Pat. No. 1,112,677, granted November 23, 1955, there is disclosed a weapon barrel cooling apparatus in which a piston is displaced in a cylinder by virtue of the recoil of the weapon barrel in relation to the gun mount. Due to this movement of the piston within the cylinder a certain quantity of cooling medium is injected into the interior of the weapon barrel. What is considered to be one shortcoming of this prior art construction of cooling apparatus is that it can not be used for certain weapons.

SUMMARY OF THE INVENTION

Therefore with the foregoing in mind it is a primary object of the present invention to provide an improved construction of apparatus for cooling the inner wall of a weapon barrel of a firing weapon in a manner not afflicted with the aforementioned shortcomings and drawbacks of the prior art.

Another and more specific object of the present invention aims at the provision of a new and improved construction of a cooling apparatus for the weapon barrel of a firing weapon and which is suitable for use with different types of firing weapons, does not require the use of any special control elements, generates a high pressure of the cooling fluid or coolant and insures for a high removal or dissipation of thermal energy or heat at the inner wall of the weapon barrel.

Yet a further significant object of the present invention is directed to an improved construction of cooling apparatus for cooling the inner wall of the weapon barrel of a firing weapon in a highly efficient and reliable fashion and which exploits the gas pressure generated by the propellant gases after firing of the cartridges to operate the cooling apparatus for injection of dosed quantities of the cooling fluid or coolant.

A further notable object of the present invention is concerned with an improved construction of a cooling apparatus for cooling the inner wall of the weapon barrel of a firing weapon by application of dosed or metered quantities of cooling fluid or coolant to the inner wall of the weapon barrel.

Now in order to implement these and still further objects of the invention which will become more readily apparent as the description proceeds, the cooling apparatus of the present development, among other things, is manifested by the features that there is provided a device or means for generating the injection pressure and which is arranged at the weapon barrel. This injection pressure generating device can be actuated by the pressure of the propellant gases and serves to inject a dosed quantity of cooling fluid at the requisite pressure.

BRIEF DESCRIPTION OF THE DRAWING

The invention will be better understood and objects other than those set forth above will become apparent when consideration is given to the following detailed description thereof. Such description makes reference to the annexed drawing wherein the single figure illustrates in fragmentary longitudinal sectional view a portion of a weapon barrel of a firing weapon equipped with a cooling apparatus for injection of cooling fluid or coolant into the interior of the weapon barrel and constructed according to the invention.

DETAILED DESCRIPTION OF THE PREFERRED EMBODIMENTS

Describing now the drawing, it is to be understood that to simplify the illustration thereof only enough of the construction of the firing weapon has been depicted as needed in order to enable a person skilled in the art to readily understand the underlying principles and concepts of the cooling apparatus of the present development. Turning attention now specifically to the single drawing figure, it will recognized that the rear end or end region 10 of a weapon barrel 11 possesses a cartridge chamber 12 located behind the barrel inner wall or wall surface 13, also referred to in the art as the gun bore. A cartridge or ammunition round 14 is located in the cartridge chamber or compartment 12. This cartridge 14 comprises a cartridge sleeve or jacket 15 and a projectile 16. The cartridge sleeve 15 is provided forwardly or downstream of its shoulder 17 with a sleeve neck or neck portion 18 in which there is retained the projectile or projectile member 16. The geometrical configuration or form of the cartridge chamber 12 corresponds to the geometrical configuration or form of the cartridge sleeve 15 in such a manner that the shoulder 17 of the cartridge sleeve 15 bears against a substantially conical portion or region 19 of the cartridge chamber 12. At least one cooling fluid channel or duct 23 opens at the barrel inner wall 13 at a location forward or downstream of the sleeve neck 18 of the cartridge sleeve 15. This cooling fluid channel or duct 23 is located in the weapon barrel wall or wall member 26.

Continuing, a housing or housing member 27 is affixed by means of threaded bolts or screws 25 or equivalent attachment elements at the weapon barrel wall or wall member 26. Within this housing 27 there is located the device constructed in accordance with the invention and serving for the injection of cooling fluid or coolant, typically water, into the interior or inner space **13*a* bounded by the barrel inner wall 13 by means of the aforementioned at least one cooling channel or duct 23. In the exemplary embodiment under discussion the housing 27 comprises three bores or bore portions 28, 29 and 30 through which flows the cooling fluid into the cooling fluid channel or duct 23. A first check or non-return valve 31 or equivalent structure is connected with the bore 30 to allow flow of the cooling fluid into the bores or bore portions 30, 29 and 28. This check valve 31 possesses a ball or spherical member 32 which is loaded by a spring or spring member 33. This check valve 31 prevents cooling fluid or coolant from flowing back, due to the pressure of the propellant gas within the inner chamber or space 13*a* of the weapon barrel 11 bounded by the barrel inner wall 13, through the cooling fluid channel or duct 23 and the bores 28, 29 and 30. A second check or non-return valve 34 or equivalent fluid-flow control structure is arranged adjacent the first check or non-return valve 31. This second check valve 34 is provided with a ball or spherical member 35 which is loaded by a spring or spring member 36**.

The second check valve 34 prevents that, following injection of the cooling fluid or coolant into the inner chamber or space **13*a* bounded by the weapon barrel inner wall 13 through the bores 30, 29 and 28 by means of the injection pump which will be described more fully hereinafter, cooling fluid can flow back into a cooling fluid or coolant container or reservoir 37. This cooling fluid container or reservoir 37** likewise will be described in greater detail hereinafter.

A first cylinder or cylinder member 38 which is provided with external threading or threads 39 is threadably connected with the housing 27. In particular, the external threading or threads 39 of the first cylinder 38 are threaded into a threaded bore 40 of the housing 27. Located within this cylinder 38 is a dosing or injection piston or piston member 41 which is attached to a piston rod or rod member 42. This piston rod 42 possesses a head or head portion 43. A helical spring 44, which bears at one end **44*a* at a bolt head or head portion 45 of the cylinder 38 and at the other end 44*b* at the piston rod-head portion 43, strives to withdraw the piston 41 out of the cylinder 38. The piston rod head portion 43 bears upon a second cylinder or cylinder member 46 which is secured by means of a support or carrier member 47 at the weapon barrel 11. This support or carrier member 47 is, for instance, shrink-fitted onto the weapon barrel 11 and possesses two bores or bore portions 48 and 49 which open into appropriate gas removal channels 50 and 51 of the weapon barre 11**.

The one gas removal channel 51 serves in known manner for triggering firing of the next cartridge or ammunition round and thus need not be here further considered since such does not constitute subject matter of the invention. The other gas removal channel 50 serves for the infeed of propellant gas to the cooling apparatus for the weapon barrel 11. The propellant gas escapes out of the inner chamber or space **13*a* bounded by the weapon barrel inner wall 13 through the gas removal channel 50, the bore 48 of the support or carrier member 47 into a bore 52 located at the front end of the second cylinder 46 and moves from such bore 52 into the interior or internal space or chamber 53 of the cylinder 46. In this internal space or chamber 53 of the cylinder 46 there is located a displaceable piston or piston member 54, defining a pressure-exerting piston, which is attached to a piston rod or rod member 55. This piston rod 55 bears against the aforementioned head or head portion 43 of the other piston rod or rod member 42. The piston rod 55 is encircled by a which form a ring or annular spring package or assemblage 56*a* serving for catching the piston or piston member 54** when the latter is suddenly propelled towards the rear towards the right of the drawing by the action of the propellant gases as considered with respect to the direction of firing of the firing weapon.

Continuing, it will observed that in the cooling fluid container or reservoir 37 there is located a displaceable piston or piston member 57 at which there is attached a piston rod or rod member 58. The piston rod 58 piercingly extends through a cover or closure 59 of the cooling fluid container 37. This piston rod 58 is here shown to be surrounded by one or two helical springs or spring members 60 and 61. These two springs 60 and 61 bear at one end thereof at the piston 57 and at the other end at the cover or closure 59 and strive to press the piston 57 against the cooling fluid or coolant located in a chamber or compartment 62 of the container or reservoir 37. As a result, the cooling fluid within the chamber or compartment 62 is forced to flow out of the chamber 62 into a bore 63 and by means of the check valve 34 which is then opened flows into the chamber or compartment 64 of the cylinder 38.

The cooling fluid container or reservoir 37 possesses an external threading or threads 65 by means of which this cooling fluid container 37 can be threadably connected with the internal threads or threading 66 of the housing 27. Furthermore, a line or conduit 67 is threadably connected with the housing 27 and through which cooling fluid or liquid likewise can flow into the bore 63. This cooling fluid or liquid is located in a not particularly illustrated container or supply and is subjected to atmospheric pressure. This supply of cooling fluid can be used to refill the container or reservoir 37 with cooling fluid or coolant when needed.

Having had the benefit of the foregoing description of the cooling apparatus for cooling the weapon barrel of a firing weapon the mode of operation thereof now will be described and is as follows:

Upon firing a cartridge 14 there is formed a gas pressure of the propellant gas behind the fired cartridge 14 and internally of the weapon barrel 11. In the event that propellant gas should somehow penetrate into the cooling fluid channel or duct 23 and the bores or bore portions or bore means 28, 29 and 30 then the check valve 31 prevents such propellant gas from reaching the chamber or compartment 64 of the cylinder 38. As soon as the fired projectile 16 is located in front of the gas removal channel 50 the propellant gas flows through such gas removal channel 50, through the bore or bore means 48 of the support or carrier member 47, through the bore or bore means 52 of the cylinder 46 and arrives at the internal space or chamber 53 of the cylinder 46. As soon as propellant gas has reached such internal space or chamber 53 of the cylinder 46, then the piston 54 is displaced towards the rear (towards the right of the drawing), as viewed in the direction of firing of the firing weapon, and impacts against the annular spring package or assemblage **56*a* composed of the resilient or spring rings 56, and which package of spring rings 56 serves to catch or entrap the piston 54 and dissipate a large quantity of the kinetic energy which the propellant gas has transmitted to the piston 54**.

Continuing, the piston 54 now impacts by means of the piston rod 55 against the head or head portion 43 of the piston rod 42, so that the piston 41 secured to this piston rod 42 is likewise displaced towards the rear as viewed in the direction of firing of the firing weapon. Due to this displacement or shifting of the piston 41 cooling fluid or coolant is ejected out of the chamber or compartment 64 of the cylinder 38 through the check valve 31 through the bores or bore means 30, 29 and 28 of the housing 27, and through the at least one cooling fluid channel or duct 23 into the interior or inner space **13*a* of the weapon barrel 11. During the afore-described displacement of the piston 41 with the piston rod 42 and the head or head portion 43 the helical spring 44 is compressed. As soon as the propellant gas has escaped out of the interior space or chamber 53 of the cylinder 46, then the helical spring 44 is capable of again retracting both of the pistons or piston members 41 and 54 back into their starting positions. As a result, cooling fluid or coolant is sucked out of the cooling fluid container or reservoir 37 and arrives by means of the check valve 34 in the chamber or compartment 64 of the cylinder 38**.

The aforedescribed operation repeats upon firing of each cartridge or round 14 and in this way the barrel inner wall 13, can be effectively cooled upon firing of each cartridge or round due to the aforedescribed dosed or metered injection of the cooling fluid or coolant.

It is here further mentioned that in the illustration of the drawing the piston 57 has been shown in its upward terminal position within the cooling fluid container or reservoir 37, but when such cooling fluid container or reservoir 37 is filled with cooling fluid by, for instance, flow through the supply line or conduit 67, such displaceable piston 57 is located in its other lower terminal position in relation to the showing of the drawing.

Instead of using a single cooling fluid channel channel or duct 23 it would be possible to uniformly distributively arrange at the circumference of the weapon barrel a plurality of such channels or ducts. Also instead of using a single rim or annular distribution of cooling fluid channels or ducts 23 there could be provided further forwardly or downstream of the depicted cooling fluid channel 23 and within the weapon barrel a further rim or annular distribution of cooling fluid channels 23 which, however, have not been particularly illustrated in the drawing to simplify the representation of the cooling apparatus. Finally, it is mentioned, that instead of using as the cooling fluid or coolant a liquid coolant, such as for instance water, a different cooling fluid or coolant can be employed, for instance compressed air.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for cooling an inner wall of a barrel wall of a weapon barrel of a firing weapon, comprising:

at least one cooling fluid channel for injection of a cooling fluid into the interior of the weapon barrel at a rear end portion of the weapon barrel;

means for dosing the infeed of the cooling fluid into the weapon barrel;

said at least one cooling fluid channel being located at the barrel wall of the weapon barrel and opening at the inner wall of the weapon barrel;

means for generating an injection pressure for the injection of the cooling fluid into the interior of the weapon barrel;

said injection pressure-generating means being in flow communication with the interior of the weapon barrel such that the injection pressure-generating means can be actuated by the pressure of propellant gas generated upon firing of a cartridge from the weapon barrel;

said injection pressure-generating means cooperating with the dosing means for injecting a dosed quantity of cooling fluid at a required pressure into the interior of the weapon barrel;

said injection pressure-generating means comprising piston means actuatable by the gas pressure of the propellant gas;

said dosing means comprising dosing piston means cooperating with said piston means of said injection pressure-generating means;

said dosing piston means comprising an injection piston with which a dosed quantity of the cooling fluid can be injected into the interior of the rear end portion of the weapon barrel;

said piston means of said injection pressure-generating means comprises a pressure-exerting piston acting upon said injection piston;

said two pistons possessing different diameters from one another with said pressure-exerting piston having a larger diameter than said injection piston;

said pressure-exerting piston possessing the larger diameter being impinged by propellant gas; and said injection piston possessing the smaller diameter being impinged by the cooling fluid.

2. The cooling apparatus as defined in claim 1, further including;

a package of annular spring means for braking the pressure-exerting piston; and helical spring means for retracting the injection piston back into a predetermined starting position.

3. The cooling apparatus as defined in claim 2, wherein:

said dosing means comprise first housing means secured to the weapon barrel;

said first housing means being provided with a first cylinder for receiving the injection piston possessing the smaller diameter;

said injection pressure-generating means comprising support means provided with a second cylinder; and said second cylinder serving for the displaceable reception of said pressure-exerting piston possessing the larger diameter.

4. An apparatus for cooling an inner wall of a barrel wall of a weapon barrel of a firing weapon, comprising:

at least one cooling fluid channel for injection of a cooling fluid into the interior of the weapon barrel at a rear end portion of the weapon barrel;

means for dosing the infeed of the cooling fluid into the weapon barrel;

said at least one cooling fluid channel being located at the barrel wall of the weapon barrel and opening at the inner wall of the weapon barrel;

means for generating an injection pressure for the injection of the cooling fluid into the interior of the weapon barrel;

said injection pressure-generating means being in flow communication with the interior of the weapon barrel such that the injection pressure-generating means can be actuated by the pressure of propellant gas generated upon firing of a cartridge from the weapon barrel;

said injection pressure-generating means cooperating with the dosing means for injecting a dosed quantity of cooling fluid at a required pressure into the interior of the weapon barrel;

cooling fluid-container means flow communicating with said dosing means;

said cooling fluid-container means containing therein a coolant fluid; and said cooling fluid-container means being provided with a piston member and spring means acting upon said piston member in order to pressurize said cooling fluid within the cooling fluid-container means.

* * * * *

UNITED STATES PATENT AND TRADEMARK OFFICE

CERTIFICATE OF CORRECTION

PATENT NO. : 4,884,490

DATED : December 5, 1989

INVENTOR(S) : ERNST HüRLEMANN

It is certified that error appears in the above-identified patent and that said Letters Patent is hereby corrected as shown below:

Column 1, line 14, after "barrel" please insert --at a predetermined location, such as at the rear weapon barrel--

Column 4, line 47, after "a" please insert --multiplicity of resilient or spring rings or ring members 56--

Signed and Sealed this

Fourth Day of December, 1990

*Attest:*

*Attesting Officer*

HARRY F. MANBECK, JR.

*Commissioner of Patents and Trademarks*